US006612312B2

(12) United States Patent
Silva

(10) Patent No.: US 6,612,312 B2
(45) Date of Patent: Sep. 2, 2003

(54) MULTIPLE CLIP HAIR FASTENER AND METHOD

(76) Inventor: David Alan Silva, 632 Loma Prieta, Aptos, CA (US) 95003

( * ) Notice: Subject to any disclaimer, the term of this patent is extended or adjusted under 35 U.S.C. 154(b) by 0 days.

(21) Appl. No.: 09/795,913

(22) Filed: Feb. 27, 2001

(65) Prior Publication Data

US 2002/0117182 A1 Aug. 29, 2002

(51) Int. Cl.[7] ..... A45D 8/16
(52) U.S. Cl. ..... 132/200; 132/273; 2/174
(58) Field of Search ..... 132/273, 275, 132/276, 277, 278, 279, 144, 145, 146, 101, 106, 57.1, 60, 63.1, 64.1, 201, 203, 207; 2/174, DIG. 11; D28/27, 32, 33, 42; 24/338, 331, 332

(56) References Cited

U.S. PATENT DOCUMENTS 290,365 A * 12/1883 Smith ..... 132/101
694,934 A * 3/1902 Machado ..... 132/145
1,345,216 A * 6/1920 Narbett ..... 24/66.4
1,642,449 A * 4/1927 Van Sickle et al. ..... 132/275
2,065,903 A * 12/1936 Levy ..... 24/332
2,428,985 A * 10/1947 O'Neil ..... 132/146
2,454,642 A * 11/1948 Finman ..... 132/141
3,412,739 A * 11/1968 Thatcher ..... 132/278
5,862,814 A * 1/1999 Janik et al. ..... 132/275
5,894,848 A * 4/1999 Schach ..... 132/223
6,098,636 A * 8/2000 Curtiss et al. ..... 132/277
6,327,611 B1 * 5/2001 LeCronne et al. ..... 132/275

* cited by examiner

*Primary Examiner*—Eduardo C. Robert
*Assistant Examiner*—David Comstock

(57) ABSTRACT

A multiple clip fastener and method for securing sections of hair of a human being in rows and for aligning hair clips. The apparatus is a semi-circle headband, retaining comb, or barrette that has a plurality of hair clips integrally attached and aligned longitudinally along its top. In use, the headband, retaining comb, or barrette is attached to the hair. Hair sections are then neatly aligned and secured in rows to the multiple clip fastener by placing each corresponding hair section into corresponding hair clip. Each clip always remains aligned with each other and the multiple clip hair fastener is easily removable and reusable.

6 Claims, 4 Drawing Sheets

MULTIPLE CLIP HAIR FASTENER AND METHOD

BACKGROUND OF THE INVENTION

1. Field of the Invention

The present invention and method relates to a multiple clip hair fastener. More particularly a headband, retaining comb, and barrette with a plurality of hair clips integrally attached to their top for keeping hair sections in rows and hair clips aligned.

2. Description of Prior Art

Many people like to put their hair up in various styles. One way to put the hair up is to twist a plurality of sections of hair around the face and secure them with hair clips. This process is effective and stylish but it is difficult for a non-hairstylist to achieve, especially when trying to align each hair section with the previous and trying to keep the clips in alignment. It is also a time consuming process.

SUMMARU OF THE PRESENT INVENTION

An object of the present invention is to provide an instrument, which is convenient, practical, and inexpensive for use in hair styling.

A further object is to provide an instrument that will keep a plurality of hair clips neatly aligned.

A further object is to provide a single instrument that will keep a plurality of hair sections in neatly aligned rows.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided a multiple clip hair fastener comprising a flexible headband with a plurality of clips integrally attached to its top.

According to the arrangement described above the headband is placed on the user's head. The user then twists tiny sections of hair, directly in front or behind each clip, and places the section into the corresponding clip. Because all the clips are integrally attached and aligned with the headband the twisted hair sections remain in conveniently spaced apart rows and the clips don't move out of alignment.

Accordingly a preferred embodiment of the headband is a semicircle shape made of plastic with a plurality of spring loaded plastic hair clips pivotally attached and aligned longitudinally along the semicircle headband top.

According to another aspect of the present invention, there is provided a multiple clip hair fastener comprising a retaining-comb with a plurality of clips integrally attached to its top.

Accordingly a preferred embodiment of the comb version of the present invention the retaining-comb is plastic and slightly arched to form to the user's head with a plurality of spring loaded hair clips integrally attached and aligned longitudinally along the base of the retaining comb.

According to another aspect of the present invention, there is provided a multiple clip hair fastener comprising a barrette with a plurality of clips integrally attached to its top.

Accordingly a preferred embodiment of the barrette version of the present invention the barrette is a standard metal barrette with a hinge on one end and a latch at the other. A plurality of spring loaded hair clips are integrally attached and are aligned longitudinally along the base of the retaining-comb.

Other objects, features and advantages of the present invention will become apparent from the following description of the preferred embodiments given with reference to the accompanying drawings.

BRIEF DESCRIPTION OF THE DRAWINGS

In the accompanying drawings

DETAILED DESCRIPTION OF THE PREFERRED EMBODIMENTS

Figure 1:
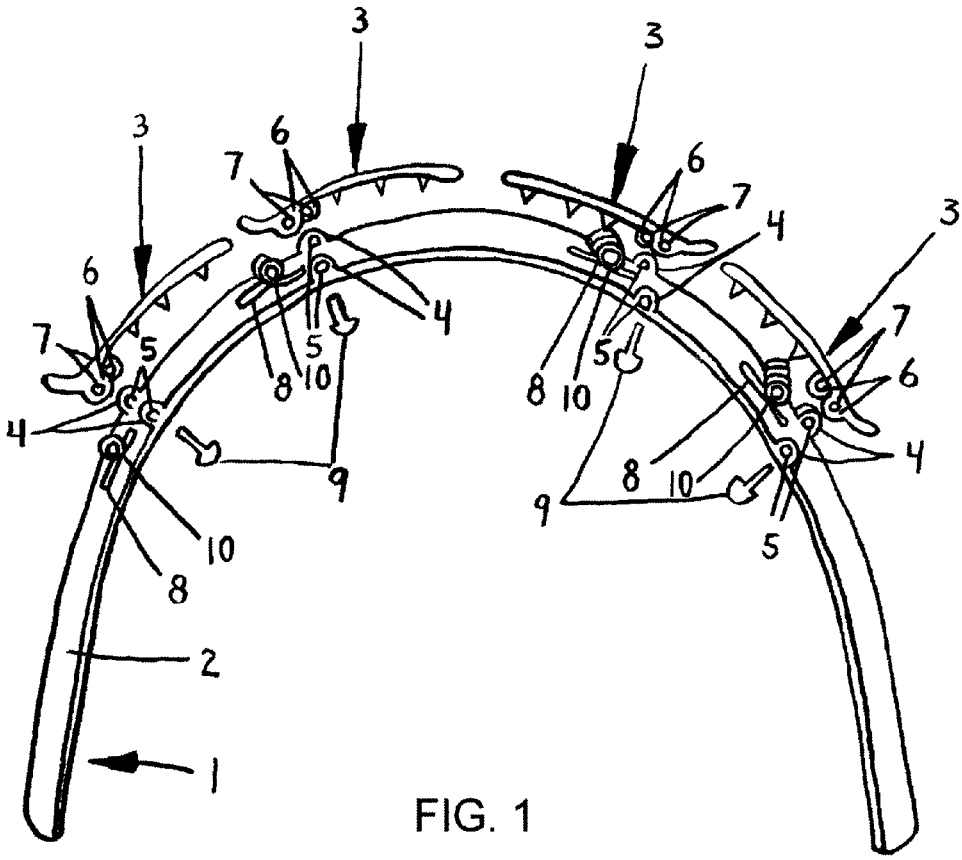
FIG. 1 is a front view showing a multiple clip headband fastener according to the present invention.
Figure 2:
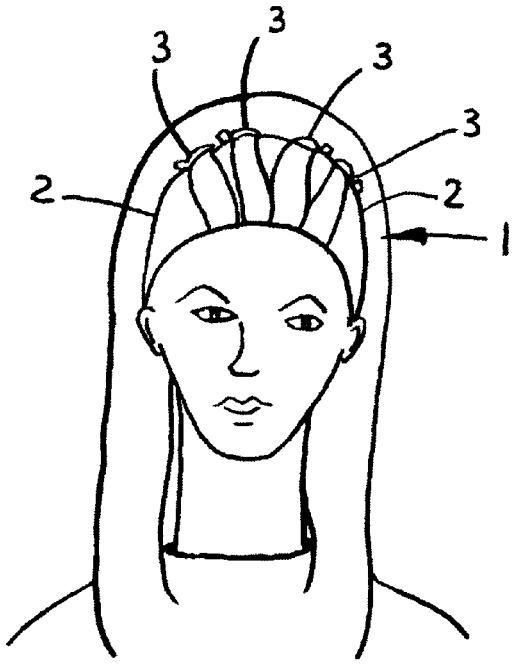
FIG. 2 is a schematic view showing the multiple clip headband fastener secured to the user's hair.

Referring to FIGS. 1 and 2 of the accompanying drawings, there is illustrated a multiple clip headband fastener, generally designated by reference numeral 1, embodying the present invention. The semi-circle headband fastener 1 comprises a first band portion 2 and a plurality of clip portions 3. Each band portion 2 has a plurality of lug portions 4 and each lug portion 4 has a hole 5. Each clip has two lugs 6 that correspond to lugs 4 and lugs 6 have holes 7 that correspond to holes 5. The semicircle portion 2 and the clip portions 3 are made of plastic. In assembly a spring 8 is placed between each lug 4 on band 2. Each clip portion 3 is placed on top each of lugs 4 while aligning lugs 6 with lugs 4. A pin 9 is placed through holes 5 and 7 and through opening 10 in spring 8.

In use of the multiple clip headband fastener the user places the present invention 1 onto their hair. The user then takes sections of hair in front or behind each clip 3 and places the corresponding section into the corresponding clip 3 to secure.

Figure 3:
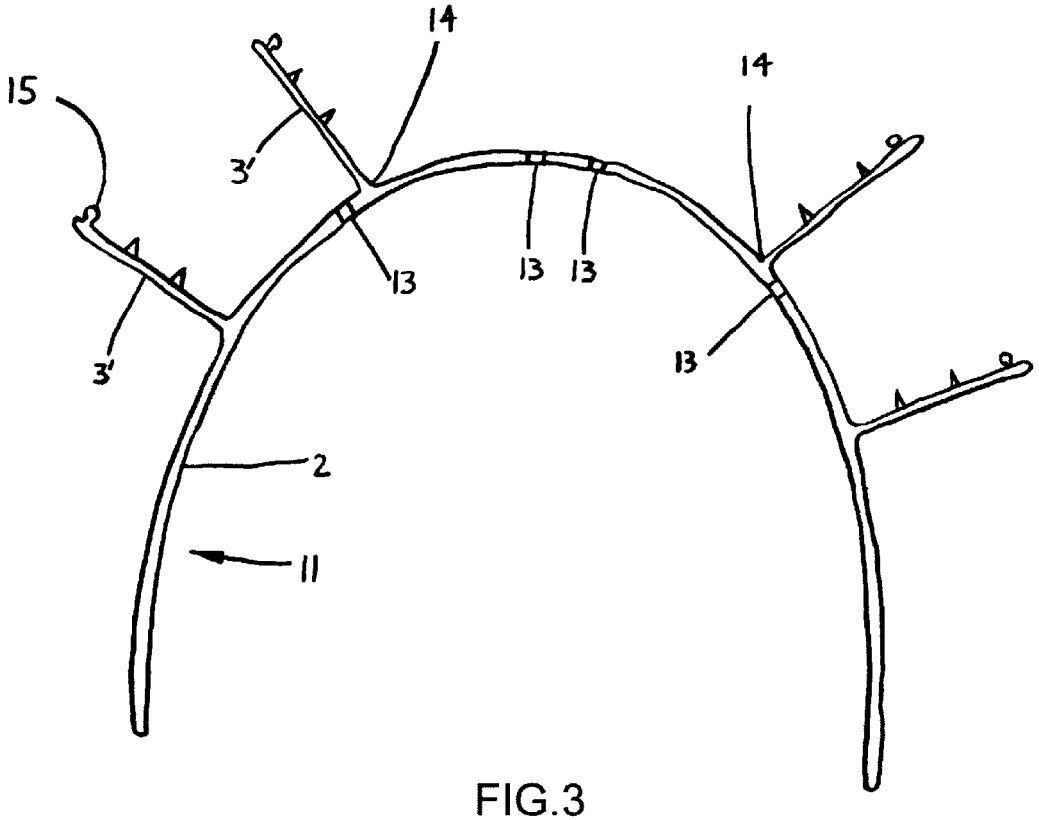
FIG. 3 is a front view of another version of the multiple clip headband fastener.

In another embodiment 11 of FIG. 3, the semicircle portion 2' has a plurality of barrettes 3' attached to the band 2'. The barrette 3' legs are hinged 14 integrally formed to band base 2'. Each barrette portion 3' has a fastening or latch means 15, which attaches barrette 3' to base 2' when barrette 3' is engaged to a corresponding fastening or latch, means 16 on base 2'.

Figure 4:
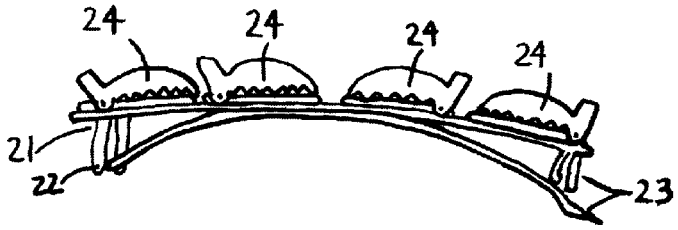
FIG. 4 is a side view of the multiple clip barrette fastener.

In another embodiment FIG. 4, a barrette 21 has a plurality of clips 24 integrally attached to its top. The preferred embodiment has a basic barrette 21 that is hinged on one side 22 and latched on the other 23. The clips 24 are attached and aligned longitudinally along to the top of barrette 21.

In assembly the bottom of separate clips are adhered to the top of the barrette.

In use the user attaches the barrette to the user'hair. The user then places sections of hair into each corresponding clip.

Figure 5:
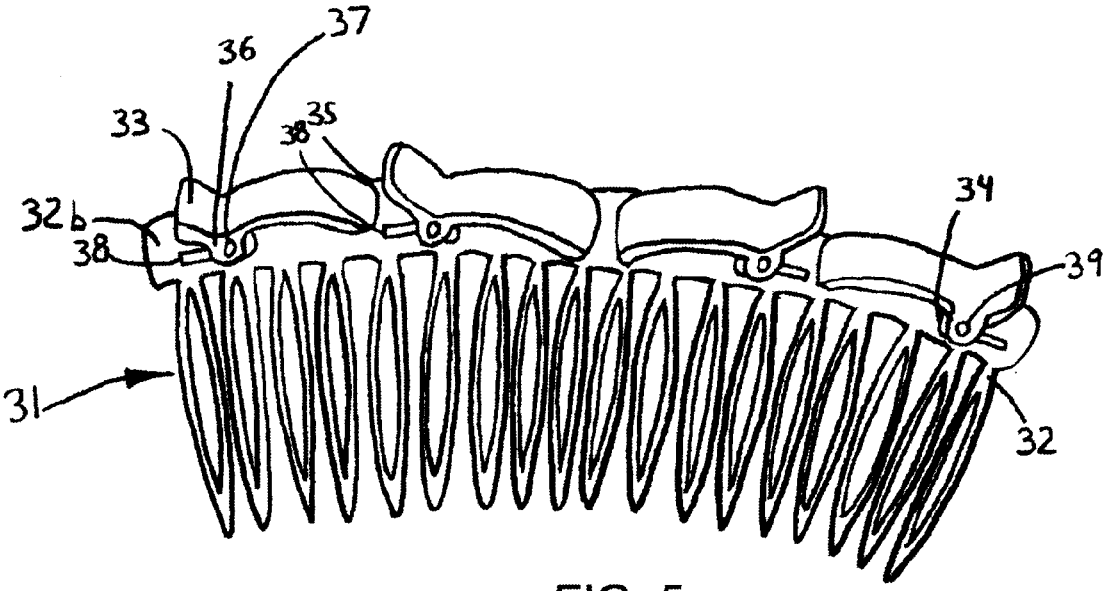
FIG. 5 is a plan view showing a multiple clip retaining-comb fastener according to the present invention.
Figure 6:
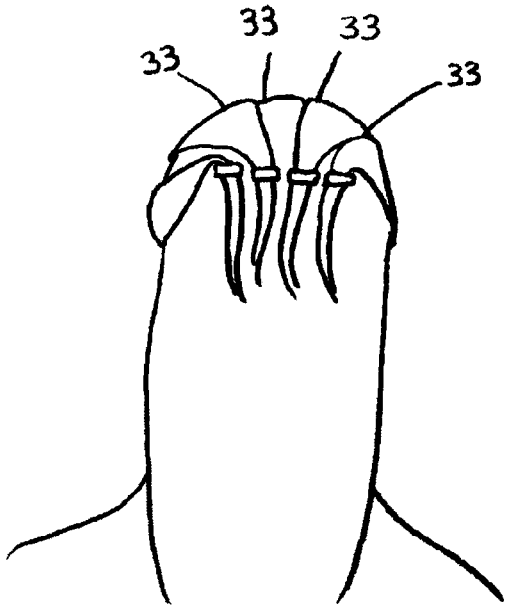
FIG. 6 is a schematic view showing the multiple clip retaining-comb fastener secured to the user's hair.

Referring to FIGS. 5 and 6 of the accompanying drawings, there is illustrated a multiple clip retaining-comb fastener, generally designated by reference numeral 31, embodying the present invention. The multiple clip retaining-comb fastener 31, comprises a first retaining-comb portion 32 and a plurality of clip portions 33. Each retaining-comb potion 32 has a base 32*b*. Base 32*b* has a plurality of lug portions 34 attached to base 32*b* and each lug portion 34 has a hole 35. Each clip portion 33 has two lug portions 36 that correspond to lugs 34 and each lug 36 has a hole 37 that corresponds to holes 35. The retaining-comb portion 32 and the clip portions 33 are made of plastic.

In assembly a spring 38 is placed between each lug 34 on comb 32. Clip portions 33 are placed on top each of lugs 34 while aligning lugs 36 with lugs 34. A pin 39 is placed through holes 35 and 37 and through spring 38.

In use of the multiple clip retaining-comb fastener 1 the user places the comb portion 2 into their hair. The user the pulls sections of hair up and places them in a corresponding clip 3 to secure.

Figure 7:
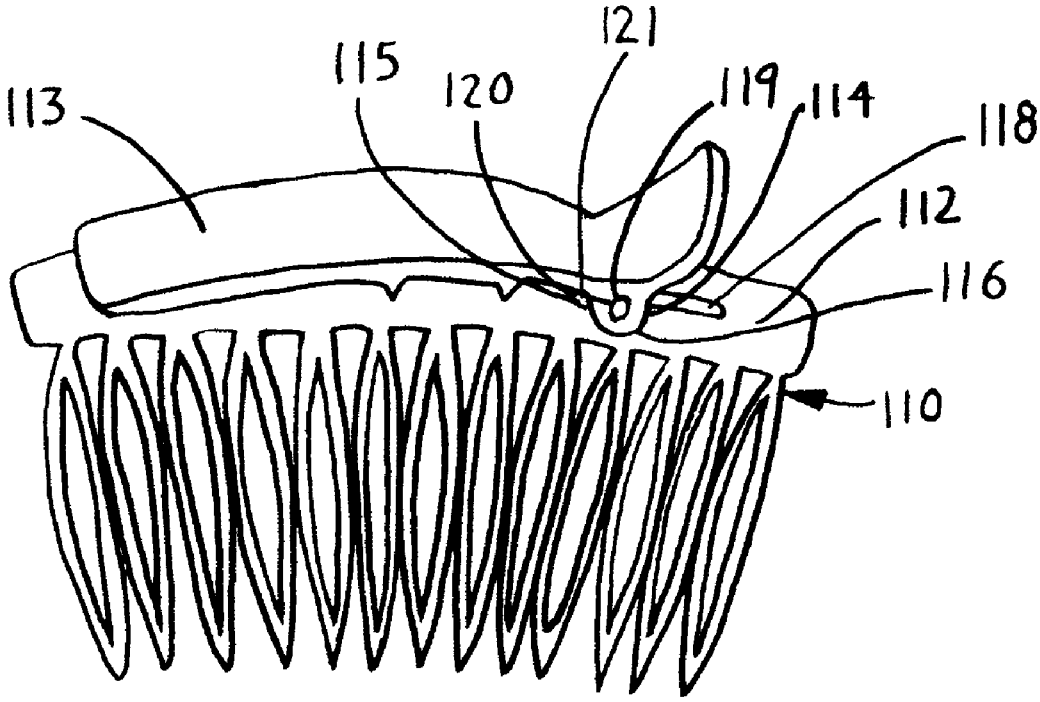
FIG. 7 is a plan view of another version of the retaining-comb fastener.

In another embodiment 111 of FIG. 7, the retaining-comb portion 110 has a single clip 113 integrally attached to the retaining-comb base 112. The single clip 113 is pivotally attached 114 to the base 112 by aligning two lugs 115 on base 112 with two lugs 116 on clip 113. Spring 118 is placed between the lugs and pin 119 is placed through holes 120 and 121 of lugs 115 and 116. The clip 113 runs parallel to the base 112.

In use the user places the comb portion 112 into their hair. The user then pulls a section of hair up and places it into the clip 113 to secure.

The present invention being thus described, it is obvious that the same may be varied in many ways. For instance, the semicircle band could be a full circle and made of elastic; the hair clips could be any type of hair clip including a barrette or booby-pin known in the art as long as they are integrally attached to the headband, barrette, or retaining-comb top; and any way to integrally attach the clips to the top of the current invention will work. Such variations are not to be regarded as a departure from the spirit and scope of the invention, and all such variations as would be obvious to those skilled in the art are intended to be included within the scope of the following claims,

I claim:

1. A multiple clip headband fastener for securing head hair sections of a human being in rows and for aligning a plurality of hair clips comprising:

a) a headband; and b) a plurality of hair clip means pivotally affixed and integrally attached to the top of said headband by attaching means, for securing sections of hair to the top of said headband;

c) said hair clips are parallel to said top of said headband and are aligned longitudinally across said headband; and, d) each said clip has a leg that opens and closes for fastening said hair sections to said headband; and e) each said leg has a clamping means for urging said leg to said headband for fastening said hair section between said top of said headband and said leg; each said clip has a bias spring engaged to said leg; and a means for securing the bias spring to the clip and the headband and constantly urging the leg towards the headband and providing for rotation of said clip relative to said headband;

whereby said headband is placed on top of the head of said human being; said hair sections of said human being are neatly aligned in rows to said headband by placing each corresponding said hair section into corresponding said hair clip; each said hair clip always remains integrally aligned with said headband; and said headband clip fastener is easily removable and reusable.

2. A multiple clip headband fastener for securing head hair sections of a human being in rows and for aligning a plurality of hair clips comprising:

a) a headband; and b) a plurality of hair clip means pivotally affixed and integrally attached to the top of said headband by attaching means, for securing sections of hair to the top of said headband;

c) said hair clips are parallel to said top of said headband and are aligned longitudinally across said headband; and, d) each said clip has a leg that opens and closes for fastening said hair sections to said headband; and e) each said leg comprises a fastening means at the open end of said leg that mates with a corresponding fastening means on said headband;

whereby said headband is placed on top of the head of said human being; said hair sections of said human being are neatly aligned in rows to said headband by placing each corresponding said hair section into corresponding said hair clip; each said hair clip always remains integrally aligned with said headband; and said headband clip fastener is easily removable and reusable.

3. A multiple clip retaining-comb fastener for securing head hair of a human being and for aligning hair clips comprising:

a) a hair retaining-comb;

b) a plurality of hair clips pivotally affixed and integrally attached to a top base of said retaining-comb by attaching means and aligned longitudinally across said top base, for securing a plurality of hair sections to said comb base;

c) said hair clips are parallel to said top of said retaining comb base and are aligned longitudinally across said retaining comb base; and, d) each said clip has a leg that opens and closes for fastening said hair sections to said base top; and, e) each said clip has a handle opposite said leg and a bias spring engaged to said clip adjacent to said handle; and a means for securing the bias spring to the clip and the retaining comb base and constantly urging the leg towards the retaining comb base and providing for rotation of said clip relative to said retaining comb base in response to pressure applied to said handle;

whereby the comb portion of said multiple clip retaining-comb fastener is placed into the hair of said human being; said hair sections of said human being are neatly placed into each corresponding said hair clip; each said clip always remains integrally aligned with said retaining-comb base; and said multiple clip retaining-comb fastener is easily removable and reusable.

4. A multiple clip barrette fastener for securing head hair sections of a human being in rows and for aligning a plurality of hair clips comprising:

a) a barrette; and b) a plurality of hair clip means pivotally affixed and integrally attached to the top of said barrette by attaching means, for securing sections of hair to the top of said barrette;

c) said hair clips are parallel to said top of said barrette, and are aligned substantially in a straight line along said barrette;

d) each said clip has a leg that opens and closes for fastening said hair sections to said barrette top; and e) each leg has a clamping means for urging said leg to said barrette for fastening said hair section between said top of said barrette and said leg;

whereby said barrette is attached to said hair of said human being; said hair sections of said human being are neatly aligned in rows to said barrette by placing each corresponding said hair section into corresponding said hair clip; each said hair clip always remains integrally aligned and attached to said barrette top; and said clip fastener is easily removable and reusable.

5. A method of securing sections of head hair of a human being in rows comprising:

a) selecting a multiple clip hair fastener comprising: a headband or retaining comb with a plurality of hair clips integrally attached to the top of said headband or retaining comb and aligned longitudinally along said top;

b) securing said headband or retaining-comb to said hair;

c) placing said sections of hair that are either in front or behind said clips into each corresponding said clip;

whereby said hair sections are neatly aligned and secured in rows to said multiple clip hair fastener and said integrally attached clips always stay in alignment with said top and said multiple clip hair fastener is easily removable and reusable.

6. A method of securing sections of head hair of a human being in rows comprising:

a) selecting a multiple clip hair fastener comprising: a barrette with a plurality of hair clip means integrally attached along the top of said barrette and aligned substantially in a straight line;

b) securing said barrette to said hair;

c) placing said sections of hair that are either in front or behind said clips into each corresponding said clip;

whereby said hair sections are neatly aligned and secured in rows to said multiple clip hair fastener and said integrally attached clips always stay in alignment with said top and said multiple clip hair fastener is easily removable and reusable.

* * * * *